US008049698B2

(12) United States Patent
Koo et al.

(10) Patent No.: US 8,049,698 B2
(45) **Date of Patent: *Nov. 1, 2011**

(54) LIQUID CRYSTAL DISPLAY AND DRIVING METHOD THEREOF

(75) Inventors: Sungjo Koo, Daegu (KR); Suhyuk Jang, Daegu (KR); Jongwoo Kim, Kyungbuk (KR)

(73) Assignee: LG Display Co., Ltd., Seoul (KR)

( * ) Notice: Subject to any disclaimer, the term of this patent is extended or adjusted under 35 U.S.C. 154(b) by 871 days.

This patent is subject to a terminal disclaimer.

(21) Appl. No.: 12/003,762

(22) Filed: Dec. 31, 2007

(65) Prior Publication Data

US 2009/0002302 A1 Jan. 1, 2009

(30) Foreign Application Priority Data

Jun. 28, 2007 (KR) ..... 10-2007-0064561

(51) Int. Cl.
*G09G 3/36* (2006.01)

(52) U.S. Cl. ..... 345/89; 345/96; 345/209

(58) Field of Classification Search ..... 345/87–100, 345/204, 208–210; 349/123, 124, 126, 128, 349/133, 167, 171, 172
See application file for complete search history.

(56) References Cited

U.S. PATENT DOCUMENTS

| | | | | |
|---|---|---|---|---|
| 5,831,586 | A * | 11/1998 | Hirai et al. | 345/94 |
| 6,573,881 | B1 * | 6/2003 | Kwon | 345/92 |
| 6,680,722 | B1 * | 1/2004 | Hiraki et al. | 345/96 |
| 7,030,843 | B2 * | 4/2006 | Youn | 345/86 |
| 7,327,344 | B2 * | 2/2008 | Asada et al. | 345/100 |
| 7,403,185 | B2 * | 7/2008 | Song et al. | 345/100 |
| 7,663,594 | B2 * | 2/2010 | Do et al. | 345/100 |
| 2003/0090450 | A1 * | 5/2003 | Inada et al. | 345/87 |
| 2003/0095091 | A1 * | 5/2003 | Enomoto et al. | 345/87 |
| 2004/0001038 | A1 * | 1/2004 | Ryuh | 345/87 |
| 2005/0104834 | A1 * | 5/2005 | Tsuchihashi | 345/96 |
| 2006/0164362 | A1 * | 7/2006 | Ryuh | 345/96 |
| 2006/0291298 | A1 * | 12/2006 | Kang et al. | 365/189.07 |
| 2007/0001966 | A1 * | 1/2007 | Kim | 345/96 |
| 2008/0252624 | A1 * | 10/2008 | Jang et al. | 345/204 |
| 2008/0266233 | A1 * | 10/2008 | Song et al. | 345/99 |
| 2009/0002301 | A1 * | 1/2009 | Koo et al. | 345/89 |

FOREIGN PATENT DOCUMENTS

| | | | |
|---|---|---|---|
| JP | 07-044139 | | 2/1995 |
| JP | 2000-235375 | | 8/2000 |
| JP | 2002-196731 | | 7/2002 |
| JP | 2003-255917 | | 9/2003 |
| JP | 2003255917 | A * | 9/2003 |
| JP | 2006-154772 | | 6/2006 |
| JP | 2006154772 | A * | 6/2006 |

* cited by examiner

*Primary Examiner* — Amare Mengistu
*Assistant Examiner* — Dmitriy Bolotin
(74) *Attorney, Agent, or Firm* — Morgan, Lewis & Bockius LLP

(57) ABSTRACT

A liquid crystal display includes a timing controller to activate a dynamic charge share control signal to indicate a time at which the gray level of the data voltage is changed from a white gray level to a black gray level and a time at which the polarity of the data voltage is inverted, and to activate a dot inversion control signal for widening a horizontal polarity inversion period of data voltages to be supplied to the data lines when a weakness patterns are input, and a data driving circuit supplying one of a common voltage and a charge share voltage to data lines only when the gray level of data is changed from the white gray level to the black gray level and when the polarity of the data voltage in response to the dynamic charge share control signal.

11 Claims, 19 Drawing Sheets

Fig. 8

| | | | | | | | | | | | |
|---|---|---|---|---|---|---|---|---|---|---|---|
| L1 | W | W | W | W | G | ... | G | W | W | W | W |
| L2 | B | B | B | B | W | ... | B | B | G | G | B |
| L3 | G | G | G | B | B | ... | W | W | W | W | G |
| L4 | B | B | B | B | B | ... | B | B | G | B | B |
| L5 | G | G | G | G | B | ... | G | G | G | G | W |

W B W B G

LIQUID CRYSTAL DISPLAY AND DRIVING METHOD THEREOF

This application claims the benefit of the Korean Patent Application No. 2007-0064561 filed on Jun. 28, 2007, which is hereby incorporated by reference.

BACKGROUND OF THE INVENTION

1. Field of the Invention

The present invention relates to a liquid crystal display, and more particularly to a liquid crystal display and a driving method thereof adapted to reduce the generation of heat and power consumption of a data driving circuit and to prevent the deterioration of the picture quality in the data of weakness patterns.

2. Discussion of the Related Art

A liquid crystal display displays images by controlling the light transmittance of liquid crystal cells in response to a video signal. A liquid crystal display of an active matrix type actively controls data by switching a data voltage applied to the liquid crystal cells using a thin film transistor (TFT) formed at every liquid crystal cell Clc, as illustrated in FIG. 1, thereby improving the picture quality of a motion image. As shown in FIG. 1, reference label "Cst" denotes a storage capacitor for sustaining the data voltage charged to the liquid crystal cell "Clc," "D1" denotes a data line through which the data voltage is supplied, and "G1" denotes a gate line through which a scan voltage is supplied.

The liquid crystal display is driven according to an inversion method in which a polarity is inverted between neighboring liquid crystal cells. The polarity is inverted whenever a frame period is shifted in order to reduce a direct current (DC) offset component and the degradation of liquid crystals. However, the swing width of the data voltage, which is supplied to the data lines whenever the polarity of the data voltage is shifted, is increased, thereby generating a great amount of current in a data driving circuit. Thus, problems of rising temperature due to increase in heat generation and power consumption of the data driving circuit increases sharply.

In order to reduce the swing width of the data voltage supplied to the data lines, thereby reducing the heat generated temperature and power consumption of the data driving circuit, a charge sharing circuit or a precharge circuit is adopted in the data driving circuit. However, the effects of these circuits do not provide a satisfactory result.

Further, if the polarity of the data voltage is driven according the inversion method, the charging amount of a liquid crystal cell charged by the data voltage of a positive polarity is different from that of a liquid crystal cell charged by the data voltage of a negative polarity. Thus, there is a problem in that the picture quality is degraded.

For example, as shown in FIG. 2, assuming that a liquid crystal cell is charged by the data voltage of a positive polarity and then by the data voltage of a negative polarity for representing the same gray level as that of the data voltage of the positive polarity, the liquid crystal cell maintains a voltage Vp(+) whose absolute value voltage may be lowered by as much as ΔVp due to parasitic capacitance of the TFT after being charged by the data voltage of the positive polarity. Then, the liquid crystal cell maintains voltage Vp(−) whose absolute value voltage may be increased by as much as ΔVp due to parasitic capacitance of the TFT after being charged by the data voltage of the negative polarity.

Accordingly, a liquid crystal cell of a normally black mode liquid crystal display has light transmitted therethrough with a higher light transmittance when being charged by the data voltage of a negative polarity for representing the same gray level as that of the data voltage of a positive polarity than that of the data voltage of the positive polarity. In the normally black mode, the higher the voltage charged in a liquid crystal cell, the higher the light transmittance of the liquid crystal cell.

Further, a liquid crystal cell of a normally white mode liquid crystal display has light transmitted therethrough with a lower light transmittance when being charged by the data voltage of a negative polarity for representing the same gray level as that of the data voltage of a positive polarity than that of the data voltage of the positive polarity. In the normally white mode, the higher the voltage charged in a liquid crystal cell, the lower the light transmittance of the liquid crystal cell.

In addition, a liquid crystal display has a low picture quality in the data pattern of a specific picture according to a correlation between the polarity pattern of a data voltage applied to the liquid crystal cells and the gray levels of data. Representative factors that degrade the picture quality include a phenomenon in which a greenish tint is generated in a display screen, and flicker is generated in which the luminance of a screen is shifted periodically.

For example, greenish tint may be generated in a display image when a liquid crystal display is driven according a vertical 2-dot and horizontal 1-dot inversion method (V2H1) in which the polarity of a data voltage applied to the liquid crystal cells every vertical 2-dot (or 2 liquid crystal cells) is inverted, and the polarity of a data voltage applied to liquid crystal cells every horizontal 1-dot (or 1 liquid crystal cell) is inverted. In addition, the gray levels of data supplied to odd pixels are white gray levels and the gray levels of data supplied to even pixels are black gray levels within a 1 frame period, as shown in FIG. 3. In other words, in the first, second, fifth, and sixth lines L1, L2, L5, and L6, the data voltage of all green (G) data, which have the greatest influence on the luminance, of red (R), green (G), and blue (B) data, have a negative polarity. Therefore, greenish tint is generated in the first, second, fifth, and sixth lines L1, L2, L5, and L6. This greenish phenomenon is generated because the green (G) data is biased toward any one polarity.

Another example of this greenish phenomenon is shown in FIG. 4. As shown in FIG. 4, greenish tint is generated in a display image when a liquid crystal display is driven according to a vertical 2-dot and horizontal 1-dot inversion method (V2H1), and the gray levels of data supplied to odd subpixels are white gray levels and the gray levels of data supplied to even subpixels are black gray levels.

When a liquid crystal display is driven according to a vertical 1-dot and horizontal 1-dot inversion method (V1H1) in which the polarity of a data voltage is inverted every vertical 1-dot and horizontal 1-dot so that the polarities of data voltages applied to adjacent liquid crystal cells in vertical and horizontal directions are inverted. For the data voltages that include a data voltage of white gray level and a data voltage of black gray level alternately disposed every 1 subpixel within a one frame period as shown in FIG. 5, a flicker phenomenon in which the luminance of a display image is shifted every frame period is generated. In other words, all the data voltages of white gray levels have a positive polarity and all the data voltages of white gray levels in a next frame have a positive polarity within 1 frame period. Consequently, the luminance of a display image is shifted every frame period causing flicker.

SUMMARY OF THE INVENTION

Accordingly, the present invention is directed to a liquid crystal display and a driving method thereof that substantially obviates one or more problems due to limitations and disadvantages of the related art.

An object of the present invention is to provide a liquid crystal display and a driving method thereof adapted to reduce the generation of heat and power consumption of a data driving circuit while preventing the deterioration of the picture quality in the data of weakness patterns.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display includes a liquid crystal display panel having a plurality of data lines, a plurality of gate lines crossing the plurality of data lines, and a plurality of liquid crystal cells, a timing controller to determine gray levels of input digital video data and a time at which a polarity of a data voltage to be supplied to the data lines is inverted, to activate a dynamic charge share control signal to indicate a time at which the gray level of the data voltage is changed from a white gray level to a black gray level and a time at which the polarity of the data voltage is inverted, to detect weakness patterns in which the data of the white gray level and the black gray level are regularly arranged in the input digital video data, and to activate a dot inversion control signal for widening a horizontal polarity inversion period of data voltages to be supplied to the data lines when the weakness patterns are input, a data driving circuit to convert the digital video data from the timing controller into the data voltage, to convert the polarity of the data voltage, to supply any one of a common voltage and a charge share voltage between a positive data voltage and a negative data voltage to the data lines in response to the dynamic charge share control signal, and to widen the horizontal polarity inversion period of the data voltages in response to the dot inversion control signal, and a gate driving circuit to sequentially supply a scan pulse to the gate lines under the control of the timing controller.

In another aspect, a method of driving a liquid crystal display including a liquid crystal display panel having a plurality of data lines, a plurality of gate lines crossing the plurality of the data lines, a plurality of liquid crystal cells, a data driving circuit to convert digital video data into a data voltage to be supplied to the data lines and to convert a polarity of the data voltage, and a gate driving circuit to sequentially supply a scan pulse to the gate lines, the method includes determining gray levels of digital video data and a time at which the polarity of the data voltage to be supplied to the data lines is inverted, generating a dynamic charge share control signal to indicate a time at which the gray level of the data voltage is changed from a white gray level to a black gray level and a time at which the polarity of the data voltage is inverted, detecting a weakness pattern in which data of the white gray level and the black gray level are regularly arranged in the digital video data and generating a dot inversion control signal for widening a horizontal polarity inversion period of data voltages to be supplied to the data lines when the weakness pattern is input, converting the digital video data into the data voltage, converting the polarity of the data voltage, and supplying any one of a common voltage and a charge share voltage between a positive data voltage and a negative data voltage to the data lines in response to the dynamic charge share control signal, and widening the horizontal polarity inversion period of the data voltages in response to the dot inversion control signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIGS. 8 and 9 are views illustrating data check examples of a data check unit 31 illustrated in FIG. 7;

DETAILED DESCRIPTION OF THE EMBODIMENTS

Reference will now be made in detail to the embodiments of the present invention, examples of which are illustrated in the accompanying drawings.

Figure 6:
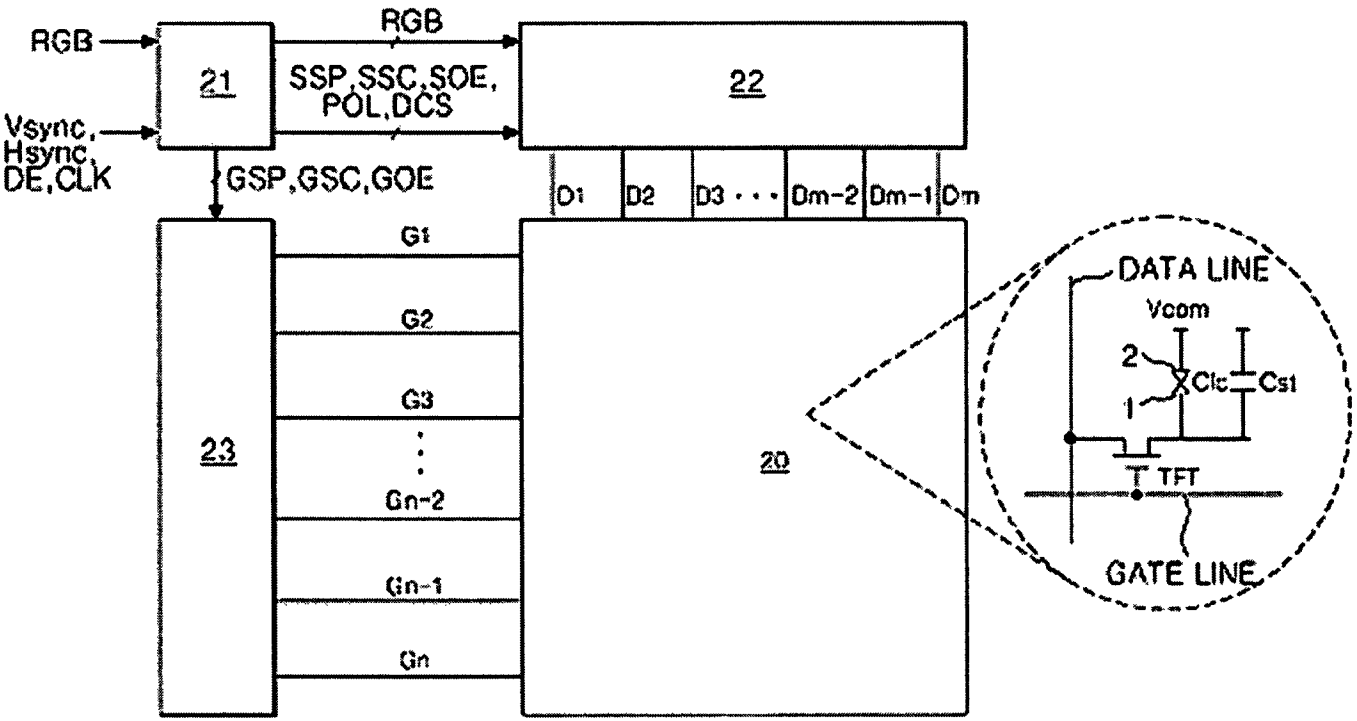
FIG. 6 is a block diagram of a liquid crystal display according to an exemplary embodiment of the present invention.

As shown in FIG. 6, a liquid crystal display according to an exemplary embodiment of the present invention includes a liquid crystal display panel 20, a timing controller 21, a data driving circuit 22, and a gate driving circuit 23. The liquid crystal display panel 20 has liquid crystal molecules injected between two sheets of glass substrates. M data lines D1 to Dm and n gate lines G1 to Gn are formed on a first glass substrate of the liquid crystal display panel 20 so that they cross each other. The liquid crystal display panel 20 includes (m×n) liquid crystal cells Clc arranged in matrix form by the intersecting structure of the m data lines D1 to Dm and the n gate lines G1 to Gn. The data lines D1 to Dm, the gate lines G1 to Gn, TFTs, pixel electrodes 1 of the liquid crystal cell Clc connected to the TFT, storage capacitors Cst, and other components are formed on the first glass substrate of the liquid crystal display panel 20.

Black matrix, color filter, and common electrodes 2 are formed on the second glass substrate of the liquid crystal display panel 20. The common electrode 2 is formed on the second glass substrate in a vertical electric field mode such as twisted nematic (TN) and vertical alignment (VA). Alternatively, the common electrode 2 is formed on the first glass substrate together with the pixel electrode 1 in a lateral electric field mode such as in-plane switching (IPS) and fringe field switching (FFS). Polarization plates having optical axes that are orthogonal to each other are attached to the first and second glass substrates of the liquid crystal display panel 20, respectively. An orientation film for setting the pre-tilt angle of liquid crystal is formed on an inner surface in contact with the liquid crystal.

The timing controller 21 receives timing signals, such as vertical/horizontal sync signals Vsync, Hsync, a data enable signal DE, and a clock signal CLK, and generates control signals for controlling the operation timing of the data driving circuit 22 and the gate driving circuit 23. The control signals include a gate start pulse GSP, a gate shift clock GSC, a gate output enable signal GOE, a source start pulse SSP, a source sampling clock SSC, a source output enable signal SOE, and a polarity control signal POL. The gate start pulse GSP controls a start horizontal line where scanning begins in a one vertical period where one screen is displayed. The gate shift clock GSC is a timing control signal input to a shift register of the gate driving circuit 23 and sequentially shifts the gate start pulse GSP and is generated with a pulse width corresponding to the on-period of a TFT. The gate output enable signal GOE controls the output of the gate driving circuit 23. The source start pulse SSP controls a start pixel in a one horizontal line in which data is to be displayed. The source sampling clock SSC controls the latch operation of data within the data driving circuit 22 on the basis of the rising or falling edge. The source output enable signal SOE controls the output of the data driving circuit 22. The polarity control signal POL controls the polarity of a data voltage to be supplied to the liquid crystal cells Clc of the liquid crystal display panel 20.

The timing controller 21 checks a time at which a gray level value of data is changed from a white gray level to a black gray level during 2 horizontal periods by analyzing the gray level of the data, and check a time at which the polarity of a data voltage will be inverted. The timing controller 21 generates a dynamic charge sharing signal (hereinafter, referred to as "DCS") for decreasing the generation of heat and consumption power of the data driving circuit 22 based on the check result of the data and polarity.

The timing controller 21 also detects a data pattern whose picture quality may be degraded due to greenish tint, flicker, etc. (i.e., weakness pattern) by checking input digital video data RGB. Dot inversion control signal DINV of a high logic is generated to convert the polarity of the data voltage according to a vertical 1-dot and horizontal 2-dot inversion method (V1H2) or a vertical 2-dot and horizontal 2-dot inversion method (V2H2) based on the data pattern. Furthermore, the timing controller 21 generates a dot inversion control signal DINV of a low logic in order to convert the polarity of a data voltage according to a vertical 1-dot and horizontal 1-dot inversion method (V1H1) or a vertical 2-dot and horizontal 1-dot inversion method (V2H1), which has a better picture quality than that of the vertical 1-dot and horizontal 2-dot inversion method (V1H2) or the vertical 2-dot and horizontal 2-dot inversion method (V2H2). The timing controller 21 does this by checking the input digital video data RGB to determine when data other than data patterns whose picture quality may be degraded, such as greenish or flicker, are input. When the dot inversion control signal DINV is a logic high, the data driving circuit 22 inverts the polarity of the data voltage according to a horizontal 2-dot inversion method, whereas when the dot inversion control signal DINV is a logic low, the data driving circuit 22 inverts the polarity of the data voltage according to a horizontal 1-dot inversion method.

The data driving circuit 22 latches digital video data RGBodd, RGBeven under the control of the timing controller 21, converts the digital video data into analog positive/negative gamma compensation voltages, generates positive/negative data voltages, and supplies the generated data voltages to the data lines D1 to Dm. A vertical inversion period of the data voltage polarity is determined according to the polarity control signal POL, and a horizontal inversion period of the data voltage polarity is determined according to the dot inversion control signal DINV. The vertical inversion period is a polarity inversion period of data voltages consecutively supplied to the respective data lines and is a polarity inversion period of liquid crystal cells that are vertically adjacent to one another. The horizontal inversion period is a polarity inversion period of the data voltages supplied to the data lines D1 to Dm and is a polarity inversion period of liquid crystal cells that are horizontally adjacent to one another.

Further, the data driving circuit 22 supplies a common voltage Vcom or a charge share voltage to the data lines D1 to Dm by performing charge sharing only when the gray level of data is changed from a white gray level W to a black gray level B and when the polarity of a data voltage, which is supplied to the liquid crystal display panel 20, is inverted in response to the source output enable signals SOE and DCS. The common voltage Vcom is an intermediate voltage between a data voltage of a positive polarity and a data voltage of a negative polarity. The charge share voltage is an average voltage generated when a data line to which the data voltage of a positive polarity is supplied and a data line to which the data voltage of a negative polarity is supplied are shorted.

In known charge sharing driving methods, charge sharing is performed between data unconditionally. In such a case, since all the data voltages supplied to the data lines D1 to Dm rise from the common voltage Vcom or a charge sharing voltage, the swing widths of the data voltages supplied to the data lines D1 to Dm are increased and the number of the rising edges of the data voltages is increased. Thus, the generation of heat and power consumption of the data driving circuit 22 is thereby increased. By contrast, in accordance with the present invention, charge sharing is performed only when the gray level of data is changed from the white gray level W to the black gray level B and the polarity of the data voltages supplied to the liquid crystal display panel 20 is inverted. Accordingly, the swing widths of the data voltages supplied to the data lines D1 to Dm and the number of rising edges of the data voltages may be reduced.

The gate driving circuit 23 includes a plurality of gate drive integrated circuits each of which includes a shift register, a level shifter for converting the output signal of the shift register to a signal having a swing width suitable for TFT driving of a liquid crystal cell, and an output buffer connected between the level shifter and the gate lines G1 to Gn. The gate driving circuit 23 is configured to sequentially output scan pulses having a pulse width of approximately one horizontal period.

Figure 7:
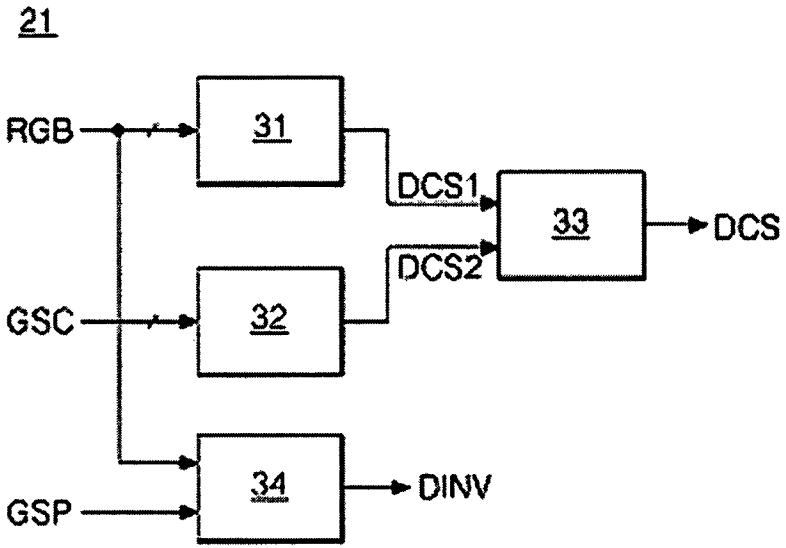
FIG. 7 is a block diagram of an exemplary dynamic charge share (DCS) generating circuit and a dot inversion control signal generating circuit.

FIG. 7 is a block diagram of a dynamic charge sharing (DCS) generating circuit that may be embedded in the timing controller 21, for example. As shown in FIG. 7, the timing controller 21 includes a data check unit 31, a polarity check unit 32, a DCS generator 33, and a dot inversion control signal generator 34.

The data check unit 31 determines whether two data consecutively input are changed from the white gray level W to the black gray level B by analyzing a gray level value of the digital video data RGB. The gray level is a gray level with respect to each data or a representative gray level of one line. Based on the data analysis, the data check unit 31 generates a first DCS signal DCS1 indicating the time at which the digital video data RGB is changed from the white gray level W to the black gray level B.

The polarity check unit 32 determines a time at which the polarity of a data voltage to be supplied to the liquid crystal display panel 20 is inverted by counting the gate shift clock GSC and generates a second DCS signal DCS2 indicating the polarity inversion time point. For example, if the data voltage is supplied to the liquid crystal display panel 20 according to the vertical 2-dot inversion method, the polarity check unit 32 counts the gate shift clock GSC, divides the count value into two, and designates the time at which the remainder becomes 0 as the time at which the polarity of data is inverted.

The DCS generator 33 performs an AND operation, for example, on the first DCS signal DCS1 and the second DCS signal DCS2 and generates a final DCS signal. The DCS signal generated from the DCS generator 33 enables charge sharing driving of the data driving circuit 22 only when data is changed from the white gray level W to the black gray level B and the polarity of a data voltage supplied to the liquid crystal display panel 20 is inverted. The DCS signal prevents charge sharing driving of the data driving circuit 22 at all other times.

Figure 1:
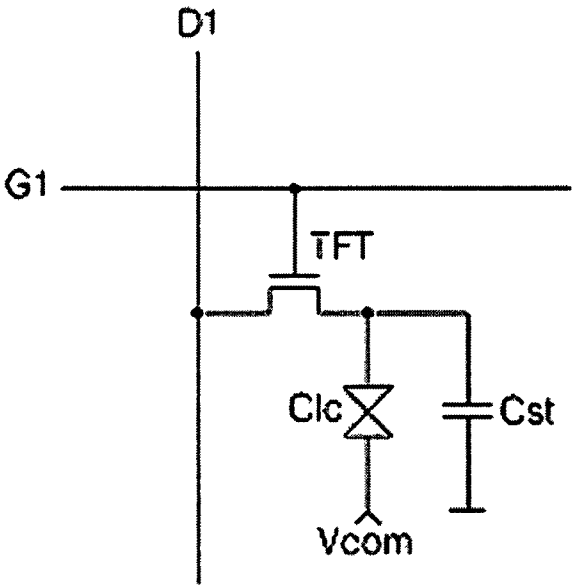
Fig. 1 [RELATED ART]
FIG. 1 illustrates an equivalent circuit diagram of a liquid crystal cell of a liquid crystal display.
Figure 2:
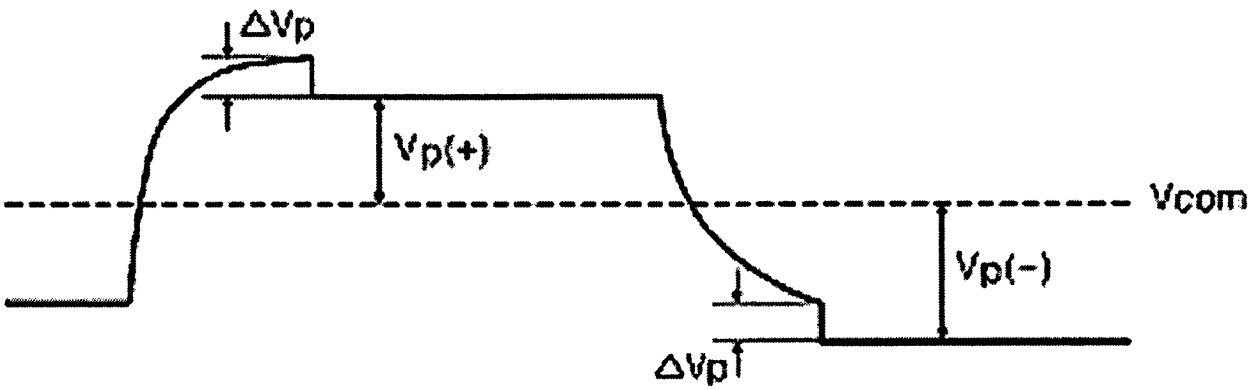
Fig. 2 [RELATED ART]
FIG. 2 illustrates a waveform of a data voltage of a positive polarity and a data voltage of a negative polarity having the same gray level and are applied to a liquid crystal cell.
Figure 3:
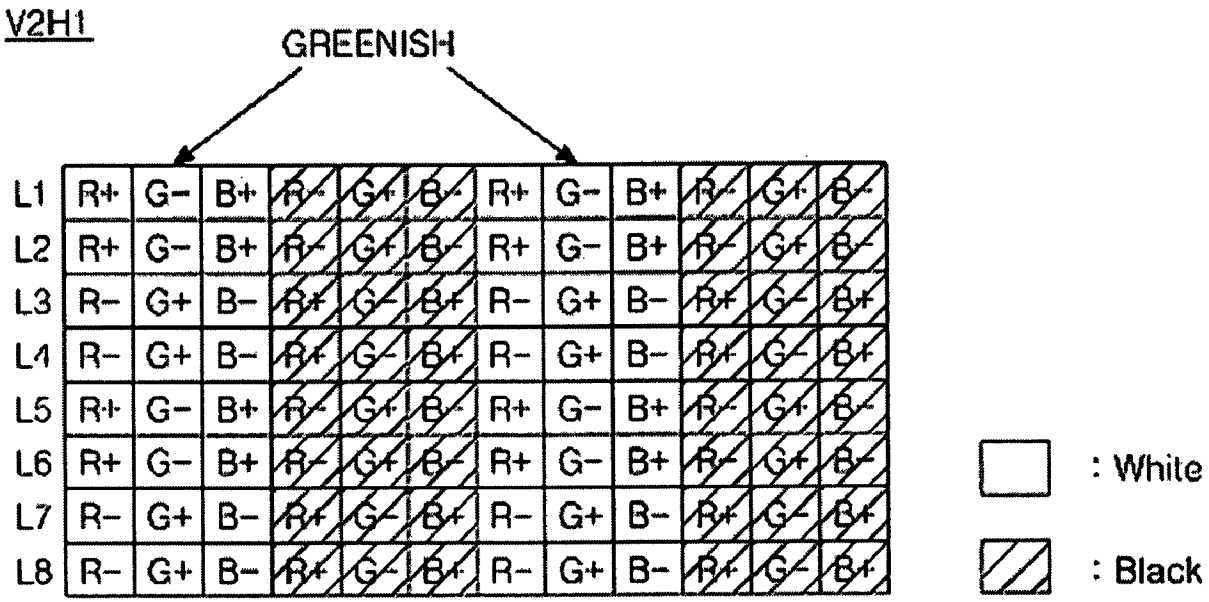
Fig. 3 [RELATED ART]
FIG. 3 is a view illustrating a greenish phenomenon of a display image, which appears when data of a white gray level are supplied to odd pixels and data of a black gray level are supplied to even pixels of a liquid crystal display driven according to a vertical 2-dot and horizontal 1-dot inversion method.
Figure 4:
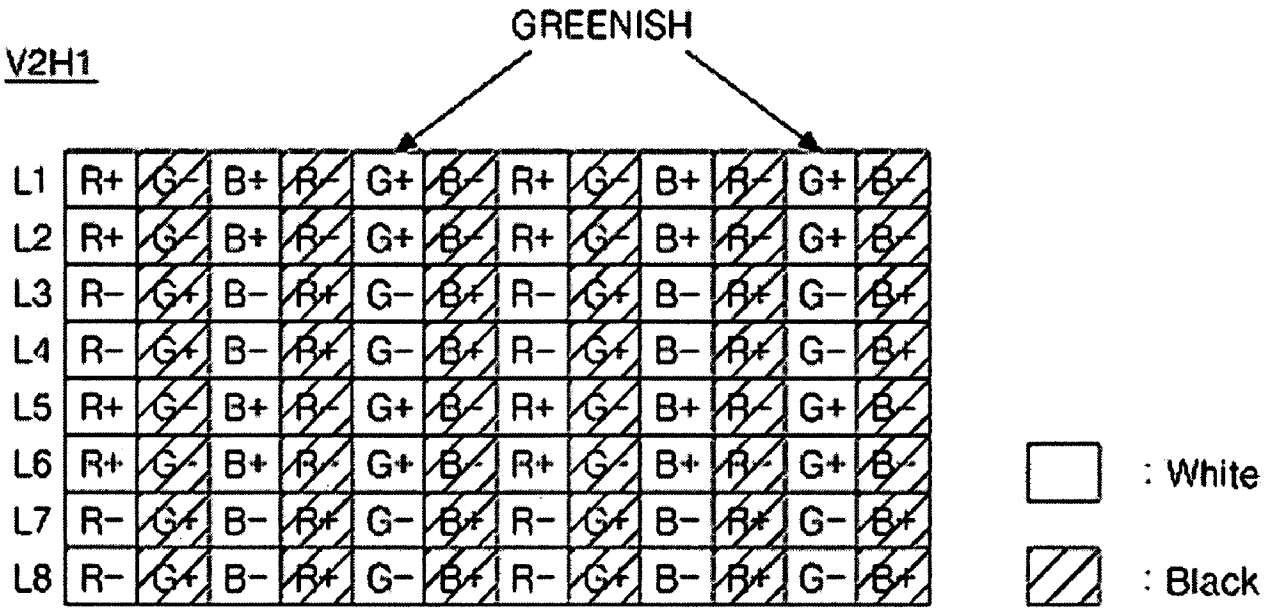
Fig. 4 [RELATED ART]
FIG. 4 is a view illustrating a greenish phenomenon of a display image, which appears when data of white gray level are supplied to odd subpixels and data of black gray level are supplied to even subpixels of a liquid crystal display driven according to a vertical 2-dot and horizontal 1-dot inversion method.
Figure 5:
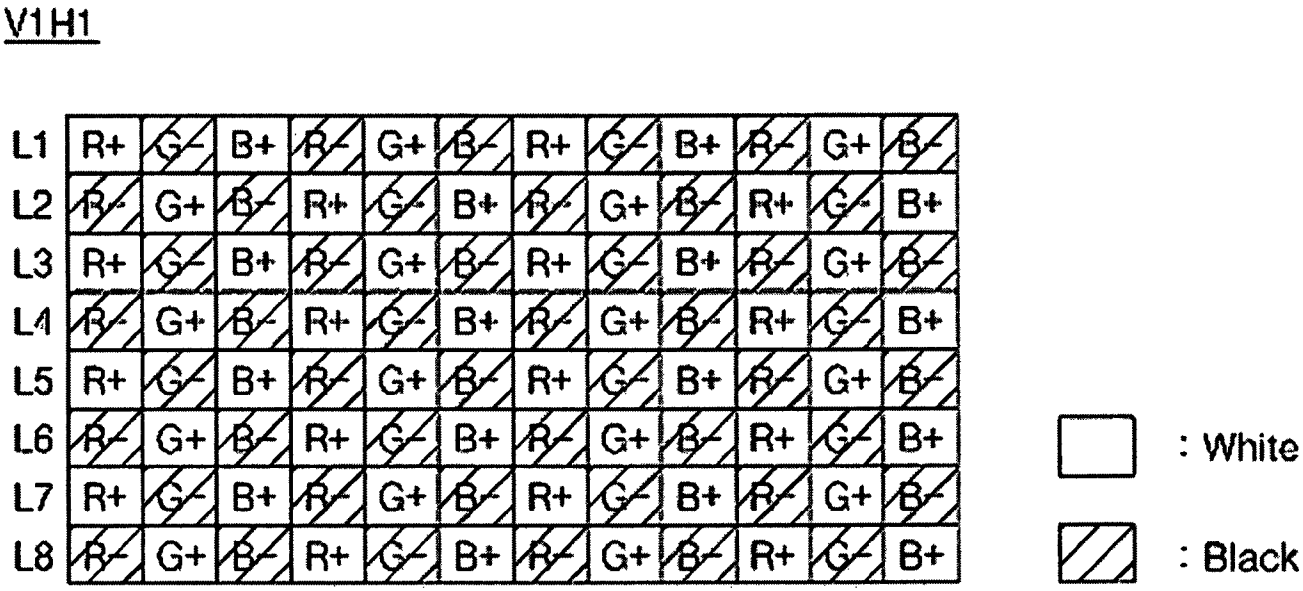
Fig. 5 [RELATED ART]
FIG. 5 is a view illustrating a flicker phenomenon of a display image, which appears when data of a subdot flicker pattern are input to a liquid crystal display driven according to a vertical 1-dot and horizontal 1-dot inversion method.

The dot inversion control signal generator 34 analyzes the input digital video data RGB to detect a data pattern whose picture quality may be degraded, such as by greenish tint or flicker, when the white gray level and the black gray level are regularly arranged, as shown in FIGS. 3 to 5. The dot inversion control signal generator 34 also generates the dot inversion control signal DINV as a high logic when data patterns whose picture quality may be degraded, such as greenish tint or flicker, are generated. On the other hand, the dot inversion control signal generator 34 generates the dot inversion control signal DINV as a low logic when data patterns other than the above patterns are input.

Figure 9:
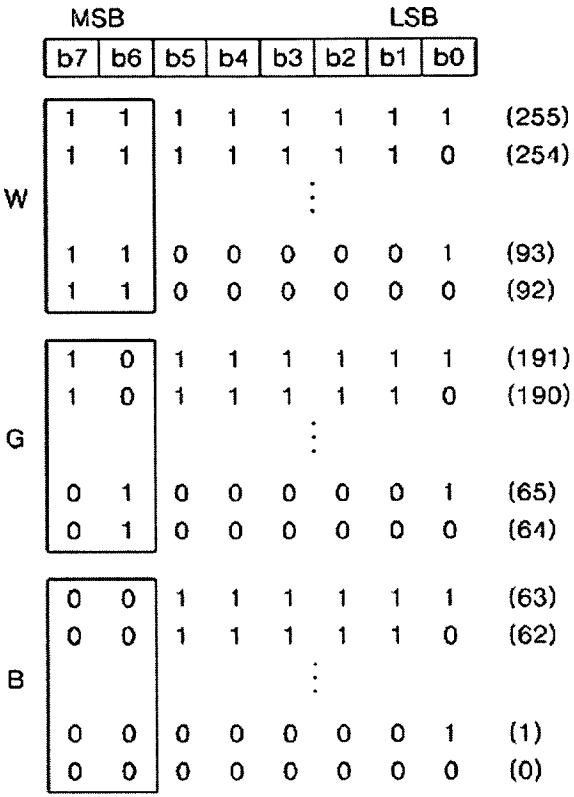

FIGS. 8 and 9 illustrate examples of data check processed in the data check unit 31. FIG. 8 is an example showing the gray levels of data supplied to liquid crystal cells disposed in five lines, and FIG. 9 illustrates the gray levels of the digital video data. The data check unit 31 determines the gray level of each data included in one line and determines a representative gray level.

For example, when data of one line is made of 1366 data, and 50% or more of the data (i.e., 683) has a white gray level W, the data check unit 31 designates the gray level of the line as being white gray level W (e.g., lines $L_1$ and $L_3$), as shown in FIG. 8. When 50% or more of the data of one line has a gray gray level G, the data check unit 31 designates the gray level of the line as being gray gray level G (e.g., line $L_5$), as shown in FIG. 8. When 50% or more of the data of the line has a black gray level B, the data check unit 31 designates the gray level of the line as being black gray level B (e.g., lines L2 and L4), as shown in FIG. 8. The criterion of the representative gray level, which is set to 50% for this example, may be changed according to the driving characteristic of the liquid crystal panel without departing from the scope of the present invention.

In the present example, the gray level of data is determined using only the most significant 2 bits (MSB) of the digital video data as shown in FIG. 9. For example, if each data is an 8-bit data, the most significant 2 bits (MSB) of upper gray levels (e.g., 192 to 255 gray levels) are "11," the most significant 2 bits (MSB) of intermediate gray levels (e.g., 64 to 191 gray levels) are "10" or "01", and the most significant 2 bits (MSB) of lower gray levels (e.g., 0 to 63 gray levels) are "00." Thus, when the most significant 2 bits of the digital video data RGB are "11," the data check unit 31 designates the gray level of the data as being white gray level W, when the most significant 2 bits of the digital video data RGB are "10" or "01," the data check unit 31 designates the gray level of the data as being gray gray level G, and when the most significant 2 bits of the digital video data RGB are "00," the data check unit 31 designates the gray level of the data as being black gray level B.

Figure 10A:
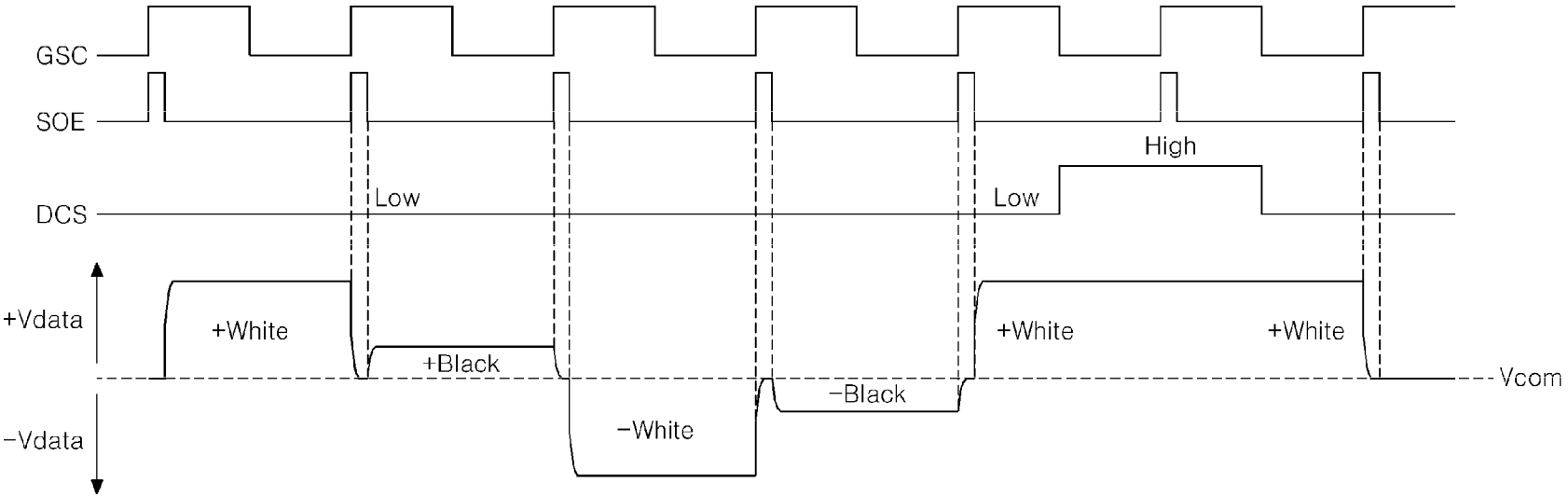
FIGS. 10A to 10C show exemplary waveforms illustrating dynamic charge sharing of the liquid crystal display according to an exemplary embodiment of the present invention.
Figure 10B:
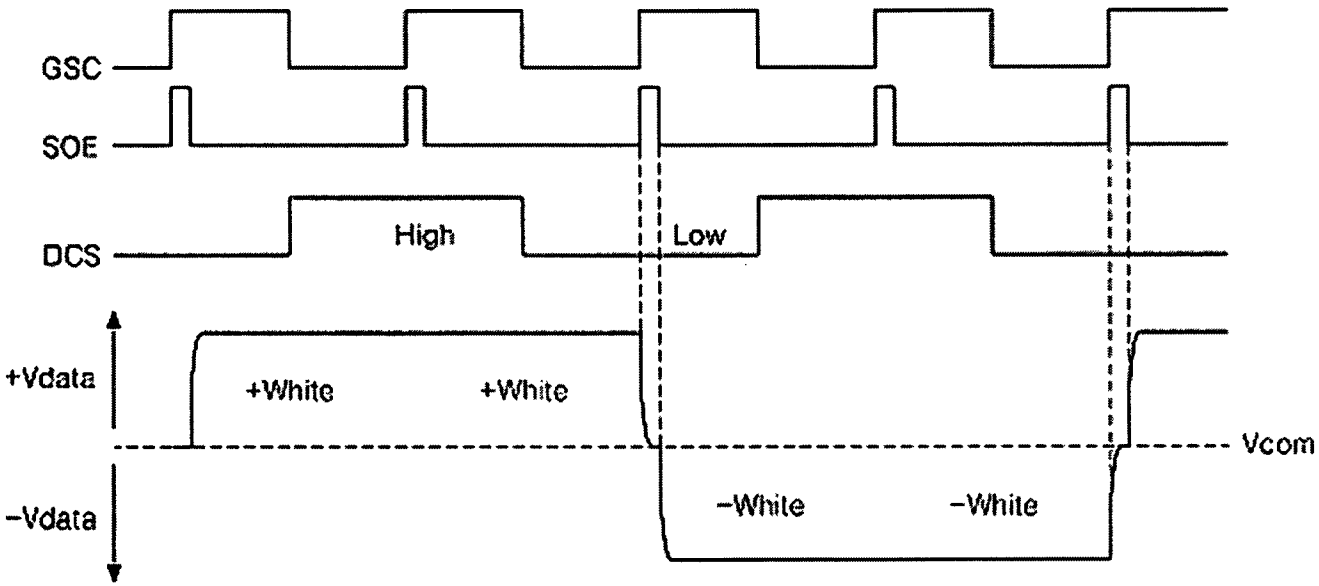
Figure 10C:
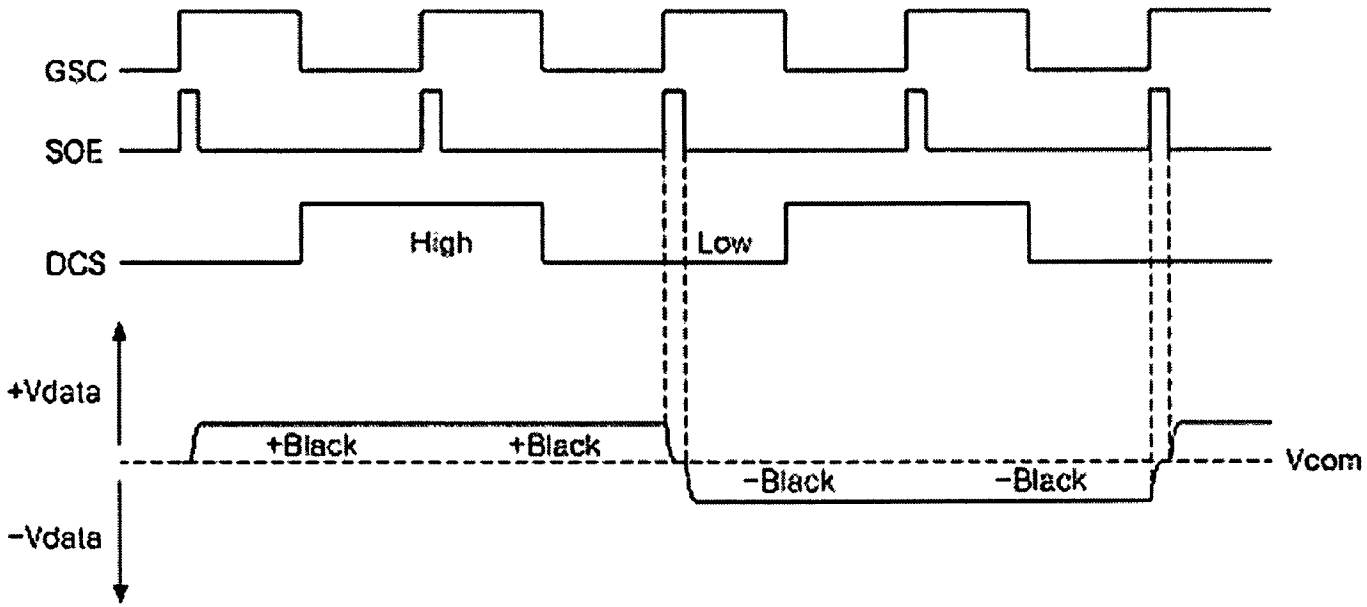

FIGS. 10A to 10C show exemplary waveforms illustrating examples of a DCS operation of the liquid crystal display according to an exemplary embodiment of the present invention. FIGS. 10A to 10C illustrate waveforms that are generated when the liquid crystal display according to an exemplary embodiment of the present invention is driven according to a vertical 2-dot and horizontal 2-dot inversion method (V2H2).

The data driving circuit 22 performs charge sharing during a non-scan period where gray levels of two data to be supplied to two liquid crystal cells vertically adjacent to each other, or representative gray levels of data to be supplied to two lines adjacent to each other, are changed from the white gray level W to the black gray level B, as shown in FIG. 10A. Further, the data driving circuit 22 performs charge sharing during a non-scan period where the polarity of two data voltages to be supplied to two liquid crystal cells that are vertically adjacent to each other is changed. However, the data driving circuit 22 prevents charge sharing when gray levels of two data to be supplied to two liquid crystal cells vertically adjacent to each other, or representative gray levels of data to be supplied to two lines adjacent to each other, are changed from the black gray level B to the white gray level W, from the black gray level B to the gray gray level G, or from the white gray level W to the white gray level W, as shown in FIG. 10B, or from the black gray level B to the black gray level B, as shown in FIG. 10C. Accordingly, the swing widths and the number of the rising edges of the data voltages supplied to the data lines D1 to Dm are reduced, thereby reducing the generation of heat and power consumption of the data driving circuit 22.

The data driving circuit 22 performs charge sharing when the DCS signal is a low logic and the source output enable signal SOE is a high logic, as shown in FIGS. 10A to 10C. On the other hand, the data driving circuit 22 does not perform charge sharing when the DCS signal is a high logic even if the source output enable signal SOE is a high logic, thereby supplying the data voltages to the data lines D1 to Dm. Further, the data driving circuit 22 supplies the data voltages to the data lines D1 to Dm irrespective of the logic level of the DCS signal when the source output enable signal SOE is a low logic.

Figure 11:
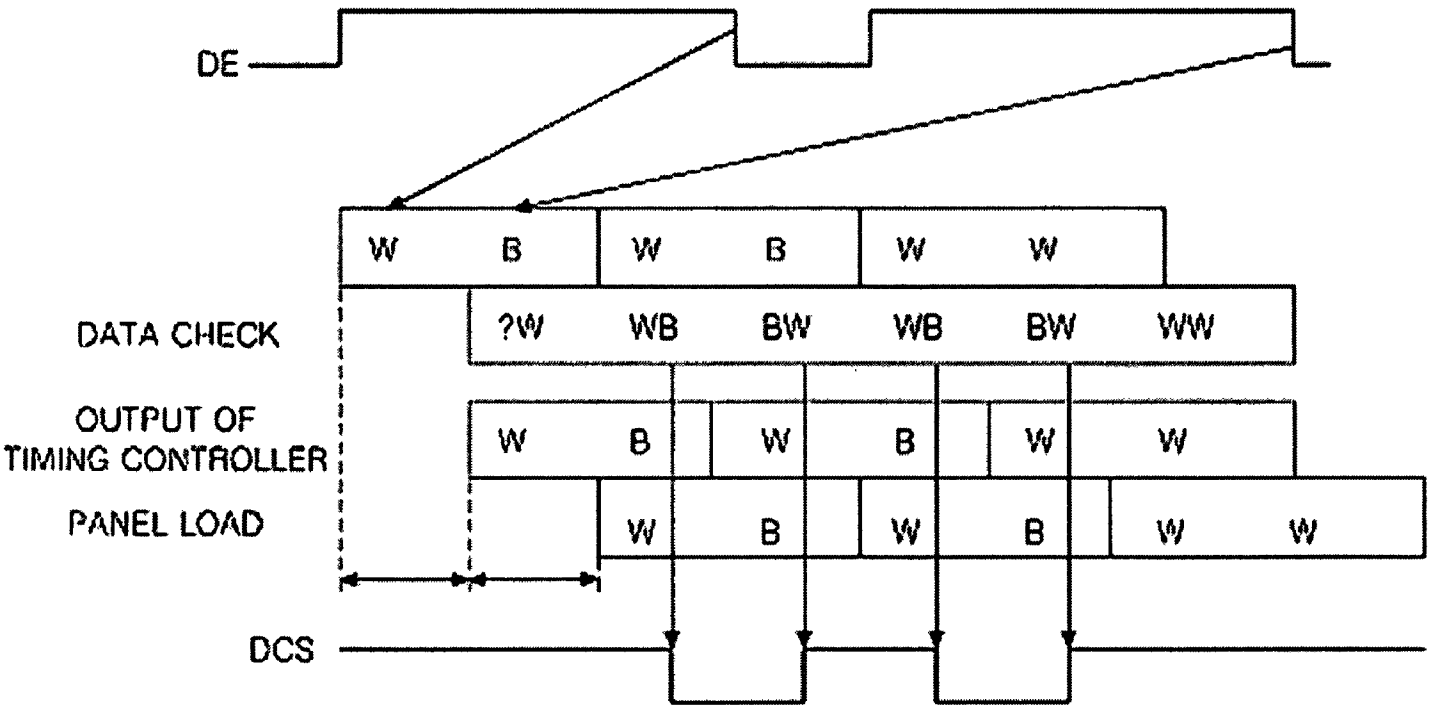
FIG. 11 shows an exemplary waveform illustrating data check of the timing controller and a data flow between the timing controller and the data driving circuit.

The driving method of the liquid crystal display according to an embodiment of the present invention checks the data of an input image at every line. The data check method in accordance with the present invention checks information about the gray levels of two line data during a period from the time when data are input to the timing controller 21 at every line to the time when data are supplied to the liquid crystal display panel 20 (hereinafter, referred to as "panel load time point"), as shown in FIG. 11. During the data analysis stage, information about the gray levels of the two line data is determined from the time of the data transmission of the timing controller 21 to the time of operation of the data driving circuit 22 and the panel load time point. Accordingly, additional memory need not be added to an existing timing controller and memory. In addition, information about the gray levels of data may be checked every line without changing the data flow of the timing controller 20 and the data driving circuit 22.

Figure 12:
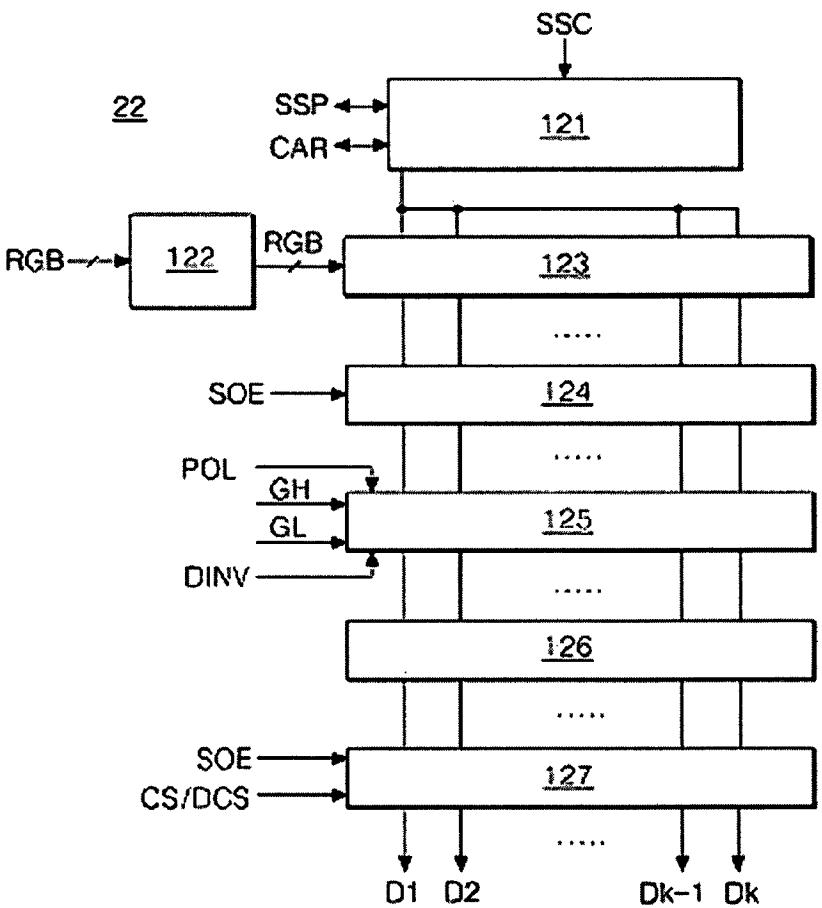
FIG. 12 is an exemplary circuit diagram of the data driving circuit illustrated in FIG. 6.

FIG. 12 is an exemplary circuit diagram of the data driving circuit 22. As shown in FIG. 12, the data driving circuit 22 includes a plurality of integrated circuits (ICs) for driving k data lines D1 to Dk (where k is an integer smaller than m). Each of the ICs includes a shift register 121, a data register 122, a first latch 123, a second latch 124, a digital/analog converter (hereinafter, referred to as "DAC") 125, an output circuit 126, and a charge sharing circuit 127.

The shift register 121 shifts the source start pulse SSP from the timing controller 21 in response to the source sampling clock SSC and generates sampling signals. The shift register 121 also shifts the source start pulse SSP and transfers a carry signal CAR to the shift register 121 of an IC of the next stage. The data register 122 temporarily stores the digital video data RGB received from the timing controller 21 and supplies the stored digital video data RGB to the first latch 123. The first latch 123 samples the digital video data RGB from the data register 122 in response to the sampling signals that are sequentially received from the shift register 121, latches the digital video data RGB, and outputs the digital video data at the same time. The second latch 124 latches the digital video data received from the first latch 123 and then outputs the digital video data, which are latched simultaneously with that of the second latch 124 of other ICs, when the source output enable signal SOE is a logic low.

The DAC 125 converts the digital video data received from the second latch 124 into a positive gamma compensation voltage GH or a negative gamma compensation voltage GL, which are analog positive/negative data voltages, in response to the polarity control signal POL and the dot inversion control signal DINV. The polarity control signal POL determines the polarity of liquid crystal cells vertically adjacent to one another, and the dot inversion control signal DINV determines the polarity of liquid crystal cells horizontally adjacent to one another. Thus, the polarity inversion period of the vertical dot inversion method is determined by the inversion period of the polarity control signal POL, and the polarity inversion period of the horizontal dot inversion method is decided by the dot inversion control signal DINV.

The output circuit 126 includes buffers that function to minimize signal attenuation of analog data voltages supplied to the data lines D1 to Dk. The charge sharing circuit 127 supplies a charge share voltage or the common voltage Vcom to the data lines D1 to Dk during a high logic period of the source output enable signal SOE when the DCS signal is a low logic.

Figure 13:
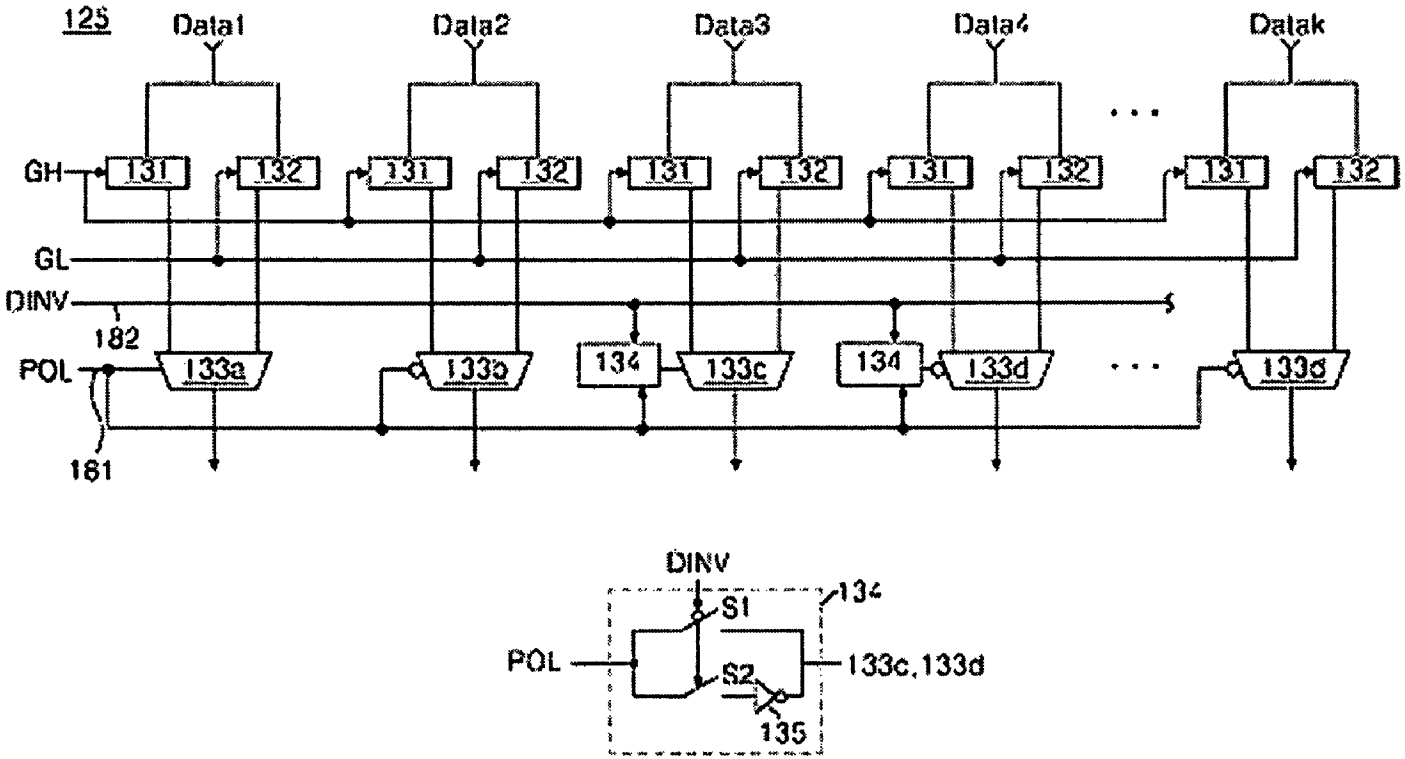
FIG. 13 is an exemplary circuit diagram of a DAC illustrated in FIG. 12.

FIG. 13 is an exemplary circuit diagram of the DAC 125 shown in FIG. 12. As shown in FIG. 13, the DAC 125 according to an exemplary embodiment of the present invention includes P-decoders (PDEC) 131 to which the positive gamma compensation voltage GH is supplied, N-decoders (NDEC) 132 to which the negative gamma compensation voltage GL is supplied, and multiplexers 133 to select between the output of the P-decoder 131 and the output of the N-decoder 132 in response to the polarity control signal POL and the dot inversion control signal DINV. The DAC 125 further includes horizontal output inversion circuits 134 for inverting the logic level of a select control signal applied to the control terminals of some of the multiplexers (e.g., multiplexers 133*c* and 133*d*) in response to the dot inversion control signal DINV.

The P-decoders 131 decode digital video data received from the second latch 124 and output a positive gamma compensation voltage corresponding to a gray level value of the digital video data. The N-decoders 132 decode digital video data received from the second latch 124 and output a negative gamma compensation voltage corresponding to a gray level value of the digital video data. The multiplexers 133 include (4i+1)th and (4i+2)th multiplexers 133*a* and 133*b* (where i is a positive integer), which are directly controlled by the polarity control signal POL, and (4i+3)th and (4i+4)th multiplexers 133*c* and 133*d*, which are controlled by the output of the horizontal output inversion circuits 134.

The (4i+1)th multiplexer 133*a* alternately selects between the gamma compensation voltage of a positive polarity and the gamma compensation voltage of a negative polarity every inversion period of the polarity control signal POL in response to the polarity control signal POL input to its non-inversion control terminal and outputs the selected positive/negative gamma compensation voltages as analog data voltages. The (4i+2)th multiplexer 133*b* alternately selects between the gamma compensation voltage of a positive polarity and the gamma compensation voltage of a negative polarity every inversion period of the polarity control signal POL in response to the polarity control signal POL input to its inversion control terminal and outputs the selected positive/negative gamma compensation voltages as analog data voltages.

The (4i+3)th multiplexer 133*c* alternately selects between the gamma compensation voltage of a positive polarity and the gamma compensation voltage of a negative polarity every inversion period of the polarity control signal POL in response to the output of the horizontal output inversion circuit 134 input to its non-inversion control terminal and outputs the selected positive/negative gamma compensation voltages as analog data voltages. The (4i+4)th multiplexer 133*d* alternately selects between the gamma compensation voltage of a positive polarity and the gamma compensation voltage of a negative polarity every inversion period of the polarity control signal POL in response to the output of the horizontal output inversion circuit 134 input to its inversion control terminal and outputs the selected positive/negative gamma compensation voltages as analog data voltages.

The horizontal output inversion circuit 134 includes switching elements S1 and S2, and an inverter 135. The horizontal output inversion circuit 134 controls the logic value of the select control signal supplied to the control terminals of the (4i+3)th multiplexer 133*c* and the (4i+4)th multiplexer 133*d* in response to the dot inversion control signal DINV. The inverter 135 is connected to the output terminal of the second switching elements S2 and the non-inversion/inversion control terminals of the (4i+3)th or (4i+4)th multiplexer 133*c* or 133*d*.

When the dot inversion control signal DINV is a high logic, the second switching element S2 is turned on and the first switching element S1 is turned off. Accordingly, the non-inversion control terminal of the (4i+3)th multiplexer 133*c* and the inversion control terminal of the (4i+4)th multiplexer 133*d* are supplied with the polarity control signal POL that is inverted. When the dot inversion control signal DINV is a logic low, the first switching element S1 is turned on and the second switching element S2 is turned off. Accordingly, the non-inversion control terminal of the (4i+3)th multiplexer 133*c* and the inversion control terminal of the (4i+4)th multiplexer 133*d* are supplied with the polarity control signal POL as is.

Figure 14:
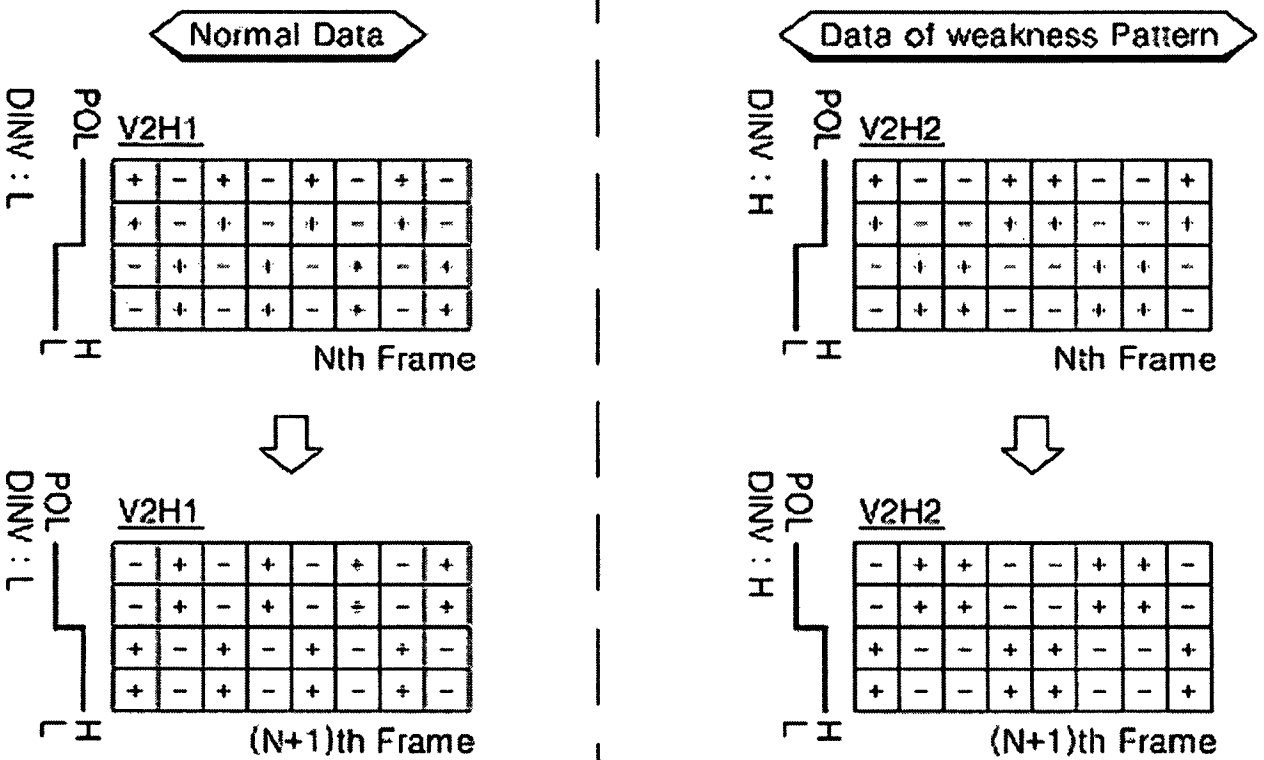
FIG. 14 is a view illustrating exemplary horizontal 1-dot inversion method and horizontal 2-dot inversion method, which are automatically selected according to a data pattern in the liquid crystal display according to an exemplary embodiment of the present invention.

As shown on the left side of FIG. 14, when the polarity control signal POL is inverted according to the vertical 2-dot inversion method and the dot inversion control signal DINV is a low logic L, an odd line horizontal polarity pattern of the data supplied to the data lines is "+−+−" during a Nth frame period and "−+−+" during a (N+1)th frame period. Accordingly, when the dot inversion control signal DINV is a low logic L, the liquid crystal display is driven according to the vertical 2-dot and horizontal 1-dot inversion method (V2H1). Meanwhile, as shown on the right side of FIG. 14, when the polarity control signal POL is inverted according to the vertical 2-dot inversion method and the dot inversion control signal DINV is a high logic H, an odd line horizontal polarity pattern of the data supplied to the data lines is "+−−+" during the Nth frame period and "−++−" during the (N+1)th frame period. Accordingly, when the dot inversion control signal DINV is a high logic H, the liquid crystal display is driven according to the vertical 2-dot and horizontal 2-dot inversion method (V2H2).

As shown in FIG. 14, the liquid crystal display according to an exemplary embodiment of the present invention activates the dot inversion control signal DINV only when data of weakness patterns (i.e., patterns that may cause the greenish phenomenon or the flicker phenomenon in a display image) are input since the data of the white gray level W and the data of the black gray level B are disposed with regularity, as shown in FIGS. 3 to 5. Accordingly, the liquid crystal display according to an exemplary embodiment of the present invention is driven according to the horizontal 1-dot inversion method, which has a high picture quality in data patterns other than the data of the weakness patterns, and according to the horizontal 2-dot inversion method, which prevents the greenish or flicker phenomenon in weakness patterns, by detecting data of the weakness patterns in the input data. Alternatively, the horizontal 2-dot inversion method may also be applied to a horizontal N-dot (where N is an integer greater than 2) inversion method. In a similar way, the vertical 2-dot inversion method may also be applied to a vertical N-dot (where N is an integer greater than 2) inversion method.

Figure 15:
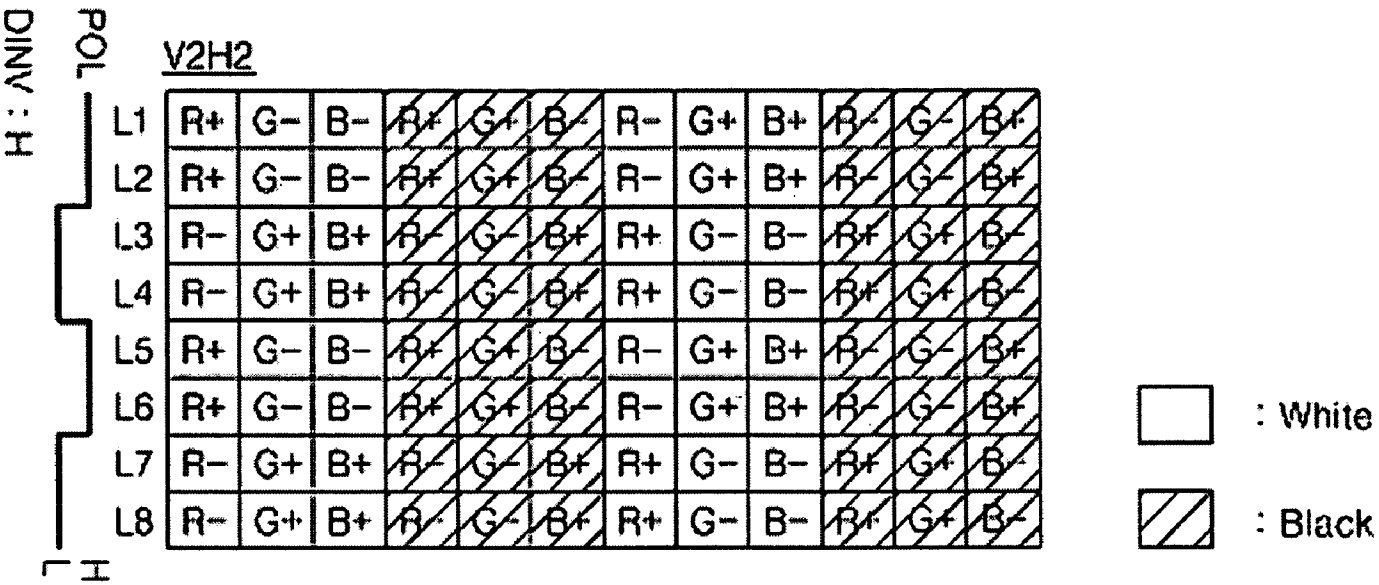
FIG. 15 illustrates an example of the horizontal 2-dot inversion method that is adaptively selected when displaying the data of the weakness pattern as illustrated in FIG. 3.
Figure 16:
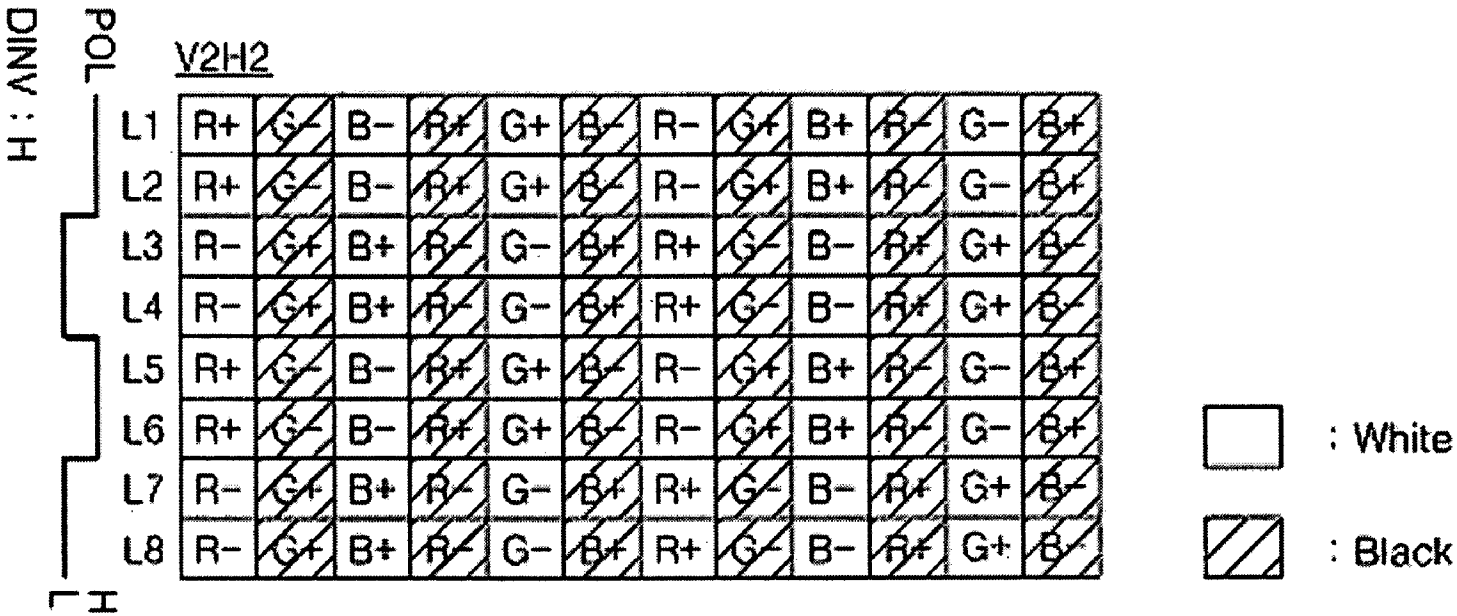
FIG. 16 illustrates an example of the horizontal 2-dot inversion method that is adaptively selected when displaying the data of the weakness pattern as illustrated in FIG. 4.
Figure 17:
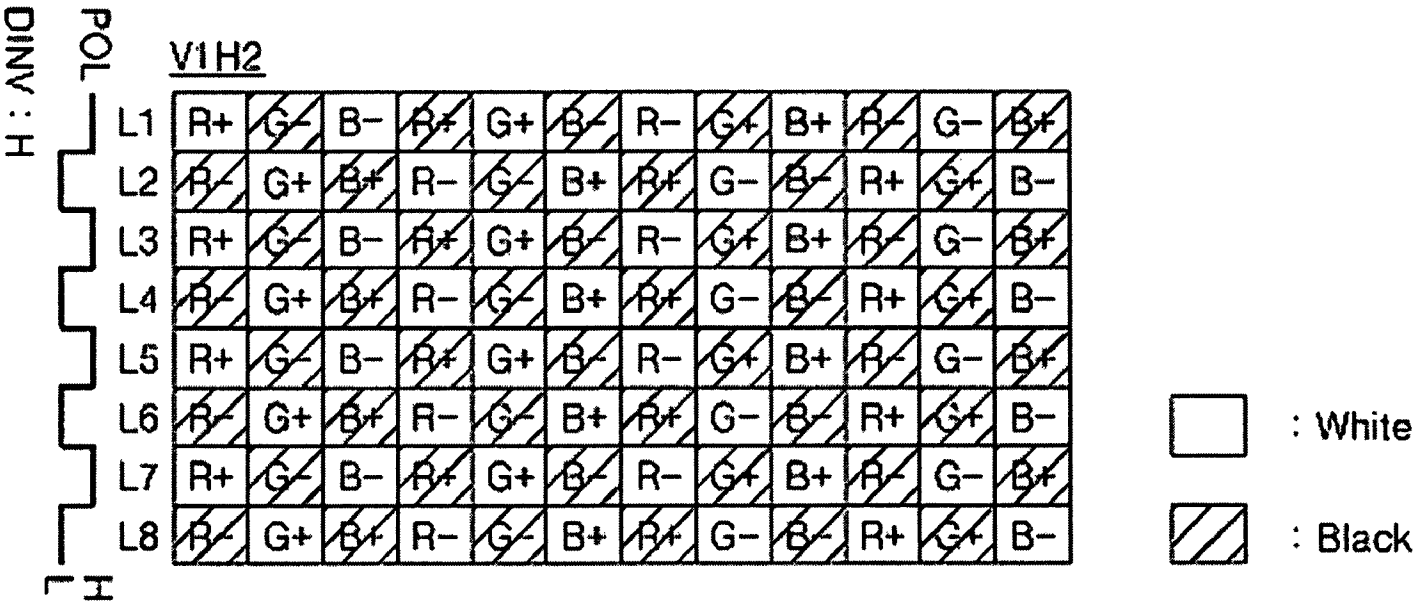
FIG. 17 illustrates an example of the horizontal 2-dot inversion method that is adaptively selected when displaying the data of the weakness pattern as illustrated in FIG. 5.

FIGS. 15 to 17 illustrate examples of the horizontal 2-dot inversion method, which is selected when data of weakness patterns, as illustrated in FIGS. 3 to 5, are input in the liquid crystal display according to an exemplary embodiment of the present invention. When the data of the weakness patterns as shown in FIG. 3 or 4 are input, the liquid crystal display according to an exemplary embodiment of the present invention detects the data of the weakness patterns and converts the data according to the horizontal 2-dot inversion method. Consequently, although the data of the weakness patterns as shown in FIG. 3 or 4 are displayed, data voltages of different polarities are charged in the green liquid crystal cells with different white gray levels, which exist in the same line as shown in FIGS. 15 and 16, so that the greenish tint is not generated in the display image.

Further, when the data of the weakness patterns as shown in FIG. 5 are input, the liquid crystal display according to an exemplary embodiment of the present invention detects the data of the weakness patterns and converts the data according to the horizontal 2-dot inversion method. Consequently, although the data of the weakness patterns as shown in FIG. 5 are displayed, the data voltage of a positive polarity and the data voltage of a negative polarity are charged in the liquid crystal cells of white gray levels as shown in FIG. 17, so that flicker is not generated in the display image.

In accordance with the liquid crystal display and the driving method thereof according to the exemplary embodiments of the present invention, gray levels of data are checked and charge sharing is performed only when the gray levels of the data change from the white gray level to the black gray level at data voltages having the same polarity, and only when the polarity of the data voltage is inverted. Accordingly, the generation of heat and power consumption of the data driving circuit may be reduced. Furthermore, when data of weakness patterns in which data of the white gray level and the black gray level are disposed with regularity are input, the driving method in accordance with the present invention is switched to the horizontal N-dot inversion method. At all other times (i.e., when data other than weakness patterns are input), the driving method is switched to the horizontal 1-dot inversion method. Accordingly, the degradation of the picture quality in any data pattern may be prevented.

It will be apparent to those skilled in the art that various modifications and variations can be made in the liquid crystal display of the present invention and driving method thereof without departing from the spirit or scope of the invention. Thus, it is intended that the present invention cover the modifications and variations of this invention provided they come within the scope of the appended claims and their equivalents.

What is claimed is:

1. A liquid crystal display, comprising:

a liquid crystal display panel having a plurality of data lines, a plurality of gate lines crossing the plurality of data lines, and a plurality of liquid crystal cells;

a timing controller to determine gray levels of input digital video data and a time at which a polarity of a data voltage to be supplied to the data lines is inverted, to activate a dynamic charge share control signal to indicate a time at which the gray level of the data voltage is changed from a white gray level to a black gray level and a time at which the polarity of the data voltage is inverted, to detect weakness patterns in which the data of the white gray level and the black gray level are regularly arranged in the input digital video data, and to activate a dot inversion control signal for widening a horizontal polarity inversion period of data voltages to be supplied to the data lines when the weakness patterns are input;

a data driving circuit to convert the digital video data from the timing controller into the data voltage, to convert the polarity of the data voltage, to perform a charge sharing in response to the dynamic charge share control signal, and to widen the horizontal polarity inversion period of the data voltages in response to the dot inversion control signal; and a gate driving circuit to sequentially supply a scan pulse to the gate lines under the control of the timing controller, wherein one of a common voltage and a charge share voltage between a positive data voltage and a negative data voltage is supplied to the data lines during the charge sharing, and wherein the data driving circuit continuously supplies the data voltage with the charge sharing only when the gray level of data and the polarity of the data voltage is unchanged.

2. The liquid crystal display of claim 1, wherein:

the timing controller further generates gate timing signals including a gate start pulse, a gate shift clock, and a gate output enable signal to control an operation timing of the gate driving circuit, and data timing signals including a source start pulse, a source sampling clock, a source output enable signal, and a polarity control signal to control an operation timing of the data driving circuit, and the polarity control signal has its logic level inverted every N horizontal period such that the polarity of the data voltage supplied to the data lines is inverted according to a vertical N-dot inversion method (where N is an integer equal to or greater than 2).

3. The liquid crystal display of claim 2, wherein the timing controller includes:

a data check unit to analyze the gray level of the digital video data in order to determine whether two digital video data that are input consecutively are changed from the white gray level to the black gray level, and to generate a first charge share signal to indicate a time at which the digital video data are changed from the white gray level to the black gray level, a polarity check unit to analyze the point of time at which the polarity of the data voltage to be supplied to the data lines is inverted by counting the gate shift clock, and to generate a second charge share signal to indicate the point of time at which the polarity of the data voltage is inverted, a dynamic charge share control signal generator to generate the dynamic charge share control signal based on the first charge share signal and the second charge share signal, and a dot inversion control signal generator to generate a high logic dot inversion control signal when the weakness patterns are input and a low logic dot inversion control signal when data other than the weakness patterns are input by checking the input digital video data.

4. The liquid crystal display of claim 3, wherein the data check unit determines a gray level of each of digital video data included in one line based on the most significant bits of each of the digital video data included in the one line, compares a dominant gray level of the digital video data included in the one line with a specific threshold value, and determines a representative gray level of one line data to be designated as the gray level of the data voltage.

5. The liquid crystal display of claim 3, wherein the data driving circuit supplies the data voltages to the data lines as a polarity of a horizontal 1-dot inversion method when the dot inversion signal is a logic low, and supplies the data voltages to the data lines as a polarity of a horizontal N-dot (where N is an integer equal to or greater than 2) inversion method when the dot inversion signal is a logic high.

6. A method of driving a liquid crystal display including a liquid crystal display panel having a plurality of data lines, a plurality of gate lines crossing the plurality of the data lines, a plurality of liquid crystal cells, a data driving circuit to convert digital video data into a data voltage to be supplied to the data lines and to convert a polarity of the data voltage, and a gate driving circuit to sequentially supply a scan pulse to the gate lines, the method comprising:

determining gray levels of digital video data and a time at which the polarity of the data voltage to be supplied to the data lines is inverted;

generating a dynamic charge share control signal to indicate a time at which the gray level of the data voltage is changed from a white gray level to a black gray level and a time at which the polarity of the data voltage is inverted;

detecting a weakness pattern in which data of the white gray level and the black gray level are regularly arranged in the digital video data and generating a dot inversion control signal for widening a horizontal polarity inversion period of data voltages to be supplied to the data lines when the weakness pattern is input;

converting the digital video data into the data voltage, converting the polarity of the data voltage, and performing a charge sharing in response to the dynamic charge share control signal; and widening the horizontal polarity inversion period of the data voltages in response to the dot inversion control signal, wherein one of a common voltage and a charge share voltage between a positive data voltage and a negative data voltage is supplied to the data lines during the charge sharing, and wherein the data driving circuit continuously supplies the data voltage with the charge sharing only when the gray level of data and the polarity of the data voltage is changed.

7. The method of claim 6, further comprising:

generating gate timing signals including a gate start pulse, a gate shift clock, and a gate output enable signal to control an operation timing of the gate driving circuit and generating data timing signals including a source start pulse, a source sampling clock, a source output enable signal, and a polarity control signal to control an operation timing of the data driving circuit, wherein the polarity control signal has its logic level inverted every N horizontal period such that the polarity of the data voltage supplied to the data lines is inverted according to a vertical N-dot inversion method (where N is an integer equal to or greater than 2).

8. The method of claim 7, wherein the dot inversion control signal is generated as a high logic when the weakness patterns are input and the dot inversion control signal is generated as a low logic when data other than the weakness patterns are input by checking the digital video data.

9. The method of claim 7, wherein the step of generating the dynamic charge share control signal includes:

analyzing the gray level of the digital video data in order to determine whether two digital video data that are input consecutively are changed from the white gray level to the black gray level and generating a first charge share signal to indicate a time at which the digital video data are changed from the white gray level to the black gray level, determining a point of time at which the polarity of the data voltage to be supplied to the data lines is inverted by counting the gate shift clock and generating a second charge share signal to indicate the point of time at which the polarity of the data voltage is inverted, and generating the dynamic charge share control signal based on the first charge share signal and the second charge share signal.

10. The method of claim 9, wherein the step of generating the first charge share signal includes determining a gray level of each of digital video data included in one line based on the most significant bits of each of the digital video data included in the one line, comparing a dominant gray level of the digital video data included in the one line with a specific threshold value, and determining a representative gray level of one line data to be designated as the gray level of the data voltage.

11. The method of claim 9, further comprising:

supplying the data voltages to the data lines as a polarity of a horizontal 1-dot inversion method when the dot inversion signal is a logic low; and supplying the data voltages to the data lines as a polarity of a horizontal N-dot inversion method when the dot inversion signal is a logic high (where N is an integer equal to or greater than 2).

* * * * *